US011927413B2

(12) United States Patent
Burke et al.

(10) Patent No.: US 11,927,413 B2
(45) **Date of Patent: *Mar. 12, 2024**

(54) FIREARM MOUNT

(71) Applicant: AOB Products Company, Columbia, MO (US)

(72) Inventors: Justin Burke, Columbia, MO (US); James Tayon, Moberly, MO (US); Mike Lindsay, Columbia, MO (US); Matthew Kinamore, Columbia, MO (US); Curtis Smith, Columbia, MO (US); Jarrod Grove, Columbia, MO (US)

(73) Assignee: AOB Products Company, Columbia, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/645,163

(22) Filed: Dec. 20, 2021

(65) Prior Publication Data

US 2022/0113105 A1 Apr. 14, 2022

Related U.S. Application Data

(63) Continuation of application No. 16/945,840, filed on Aug. 1, 2020, now Pat. No. 11,231,247.

(Continued)

(51) Int. Cl.

*F41A 23/18* (2006.01)
*F41A 3/70* (2006.01)

(Continued)

(52) U.S. Cl.

CPC ..... *F41A 23/18* (2013.01); *F41A 3/70* (2013.01); *F41A 23/005* (2013.01); *F41A 3/66* (2013.01); *F41A 23/02* (2013.01)

(58) Field of Classification Search

CPC ..... F41A 23/02; F41A 23/18; F41A 17/32; F41A 17/42; F41A 17/44

See application file for complete search history.

(56) References Cited

U.S. PATENT DOCUMENTS 4,454,672 A * 6/1984 Timari ..... F41A 3/64 42/16
4,672,762 A * 6/1987 Nilsson ..... F41A 17/32 42/70.11

(Continued)

FOREIGN PATENT DOCUMENTS

SE 501316 C2 * 1/1995 ..... F41A 17/44

OTHER PUBLICATIONS

Geissele Automatics LLC AR-15/M16 Reaction Rod, Brownells, https://www.brownells.com/gunsmith-tools-supplies/rifle-tools/barrel-tools/ar-15-m16-rea, Jul. 29, 2019, 2 pages.

(Continued)

*Primary Examiner* — Derrick R Morgan
(74) *Attorney, Agent, or Firm* — Stinson LLP

(57) ABSTRACT

A firearm mount, components thereof, and associated methods. The firearm can be configured for use with an AR-15 style firearm or other type of firearm. The firearm mount is adapted to securely hold the firearm assembly in position for cleaning, maintenance, and/or gunsmithing tasks. The firearm mount can include a lock configured to selectively lock and unlock a firearm assembly thereon.

49 Claims, 13 Drawing Sheets

Related U.S. Application Data

(60) Provisional application No. 62/883,369, filed on Aug. 6, 2019.

(51) Int. Cl.

| | |
|---|---|
| ***F41A 23/00*** | (2006.01) |
| *F41A 3/66* | (2006.01) |
| *F41A 23/02* | (2006.01) |

(56) References Cited

U.S. PATENT DOCUMENTS

| | | | | |
|---|---|---|---|---|
| 7,140,139 | B2 * | 11/2006 | Markbreit | F41A 17/44 42/70.11 |
| 8,109,195 | B1 * | 2/2012 | Spence | F41A 5/24 89/193 |
| 8,209,896 | B1 * | 7/2012 | Cashwell | F41C 27/00 269/47 |
| 8,453,367 | B2 | 6/2013 | Overstreet et al. | |
| 8,533,986 | B2 * | 9/2013 | Klotz | F41A 3/22 89/1.4 |
| 8,726,560 | B2 * | 5/2014 | Overstreet | F41A 11/02 42/69.02 |
| 8,844,182 | B2 * | 9/2014 | Ibarguren | F41A 3/18 42/70.11 |
| 9,372,041 | B1 * | 6/2016 | Geissele | F41A 35/00 |
| D768,254 | S | 10/2016 | Geissele | |
| 9,823,035 | B2 | 11/2017 | Geissele et al. | |
| 9,849,566 | B2 * | 12/2017 | Bennett | B25B 11/00 |
| 10,077,957 | B1 * | 9/2018 | Aguf | F41A 3/72 |
| 10,443,964 | B2 * | 10/2019 | Brown | F41A 3/16 |
| 10,739,101 | B2 * | 8/2020 | Jacobson | F41A 35/00 |
| 11,231,247 | B2 * | 1/2022 | Burke | F41A 3/30 |
| 2016/0202008 | A1 * | 7/2016 | Geissele | F41A 11/00 42/108 |
| 2018/0164056 | A1 * | 6/2018 | Mather | F41A 9/41 |
| 2018/0304848 | A1 * | 10/2018 | Imai | B60R 21/2644 |
| 2020/0080802 | A1 * | 3/2020 | Jennings | F41A 3/72 |
| 2020/0370853 | A1 * | 11/2020 | Jacobson | F41A 11/00 |
| 2021/0114174 | A1 * | 4/2021 | Parra | B25B 1/2457 |

OTHER PUBLICATIONS

Gnarly Gorilla, Real Avid Lug-lok Upper Vise—Block, https://gnarlygorilla.com/real-avid-lug-lok-upper-vise-block/?gclid=Cj0KCQjwyLDpBRC, Jul. 29, 2019, 3 pages.

Midwest Industries AR-15 Upper Receiver Rod Machined from 4140 Ordnance Grade, https://vitalarms.com/midwest-industries-ar-15-upper-receiver-rod-machined-from-4140, Jul. 29, 2019, 5 pages.

All About ARs: An AR-15 Breakdown of Parts, https://www.womensoutdoornews.com/2017/07/ar-15-breakdown/, downloaded Mar. 29, 2023, 12 pages.

Parts of an AR-15: List, Diagrams, and More, Feb. 22, 2022, Bear Creek Arsenal, https://www.bearcreekarsenal.com/blog/parts-of-an-ar-15.html, dated Feb. 22, 2022, 13 pages.

The Full Guide to the AR-15 Bolt Carrier Group, Sep. 13, 2019, Gun Builders Depot, https://www.gunbuilders.com/blog/the-full-guide-to-the-ar15-bolt-carrier-group/#:~:text=What is the Bold Carrier,primer on the chambered round, dated Sep. 13, 2019, 7 pages.

Understanding the AR15, May 20, 2021, Daniel Defense, https://danieldefense.com/wire/understanding-the-ar15, dated May 20, 2021, 10 pages.

* cited by examiner

FIREARM MOUNT

CROSS-REFERENCE TO RELATED APPLICATION

This continuation application claims priority to U.S. application Ser. No. 16/945,840, filed on Aug. 1, 2020, which claims priority to U.S. Provisional Application No. 62/883,369, filed on Aug. 6, 2019, the entireties of which are hereby incorporated by reference.

FIELD

The present disclosure generally relates to firearm accessories, and more particularly to a firearm mount for mounting a firearm assembly.

BACKGROUND

Several types of firearm mounts are used for mounting firearms to hold them for various purposes. For example, a user may want to hold a firearm in position for cleaning, maintenance, or gunsmithing purposes.

SUMMARY

In one aspect, a firearm mount is for supporting a firearm assembly including an upper receiver and a barrel having barrel lug structure. The firearm mount comprises a main body and a lock supported by the main body. The main body includes a rear portion and a forward portion. The forward portion is configured to be received in the upper receiver. The lock comprises at least one locking lug. The at least one lock is movable with respect to the forward portion between an unlocked position and a locked position. The lock is arranged with respect to the main body such that, when the forward portion is in the upper receiver and the at least one locking lug is in the barrel, the lock is movable from the unlocked position to the locked position to locate the at least one locking lug for engaging the barrel lug structure to obstruct removal of the firearm assembly from the main body.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Referring to FIGS. 1-9, a firearm mount of the present disclosure is designated generally by 10. The firearm mount 10 can be used to mount a firearm F or assembly thereof to hold it in position while one or more activities are performed. For example, the user may desire to hold the firearm assembly F in position for cleaning, gunsmithing, installation of firearm accessories, etc. The illustrated firearm mount 10 is configured for use with a rifle such as an AR-15 rifle, a portion of which is shown in FIGS. 1 and 10-13. It will be appreciated that other types, configurations, and constructions of firearm mounts can be used (e.g., for other types of firearms) without departing from the scope of the present disclosure.

Referring to FIGS. 1 and 10-13, the firearm assembly includes an upper receiver U, a barrel B, and a barrel nut N. A firearm assembly usable with the firearm mount can include other components or accessories (e.g., hand guard, sight, laser, bipod, etc.). The upper receiver U defines a cavity C in which the firearm mount is receivable. The cavity includes a charging handle recess CR. The upper receiver U further includes a front opening in which the barrel is received. A threaded collar C extends around the opening and has the barrel nut N thereon to capture a flange of the barrel and secure the barrel to the front opening of the upper receiver U. The barrel B includes a barrel body BB and a barrel extension BE extending rearward from the barrel body. The barrel extension BE includes lug structure (FIGS. 10, 11) defining a plurality of lugs L and a plurality of recesses R therebetween. The lugs L extend inwardly toward a bore of the barrel, and each recess R separates adjacent lugs. A cylindrical cavity CC in the barrel extension BE is provided in front of the lug structure. Persons having ordinary skill in the art are familiar with such structure of an AR-15 rifle, and the purpose and operation of the structure with respect to the operation of the firearm will not be discussed in further detail. This structure is used by the firearm mount 10 for securing the firearm assembly F on the firearm mount, and the interaction of the firearm mount with the firearm structure will be described in further detail below.

The firearm mount 10 includes a main body 12, a torque transmitter 14, and a lock assembly 16. The main body 12 and torque transmitter 14 are receivable in the upper receiver U for supporting the upper receiver. The lock assembly 16 is configured to selectively lock and unlock the firearm assembly F on the main body 12. Locking the firearm assembly F on the firearm mount 10 assists in maintaining the firearm assembly in position while various tasks are performed on the firearm assembly.

Figure 1:
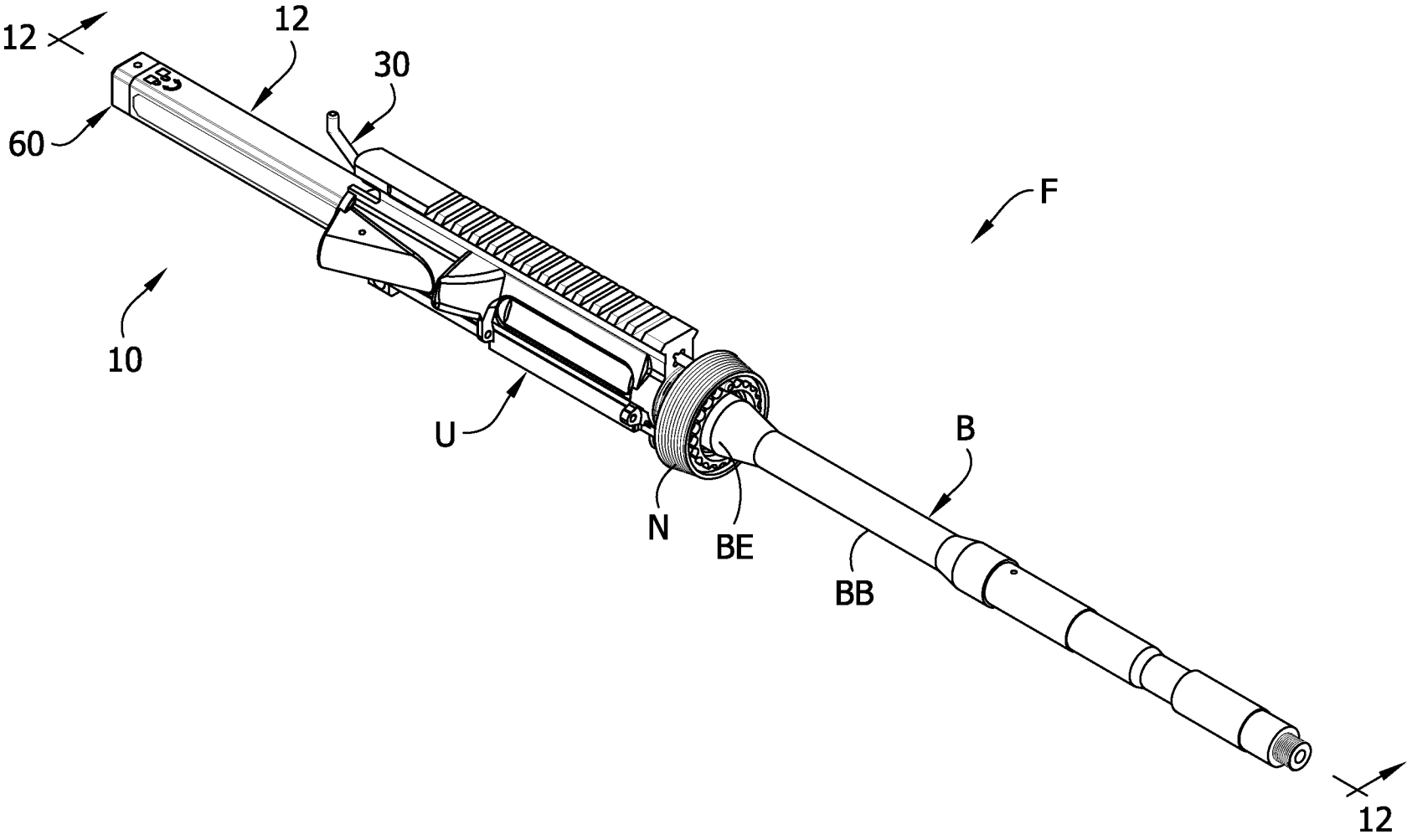
FIG. 1 is a front perspective of a firearm mount of the present disclosure installed in a firearm assembly.
Figure 2:
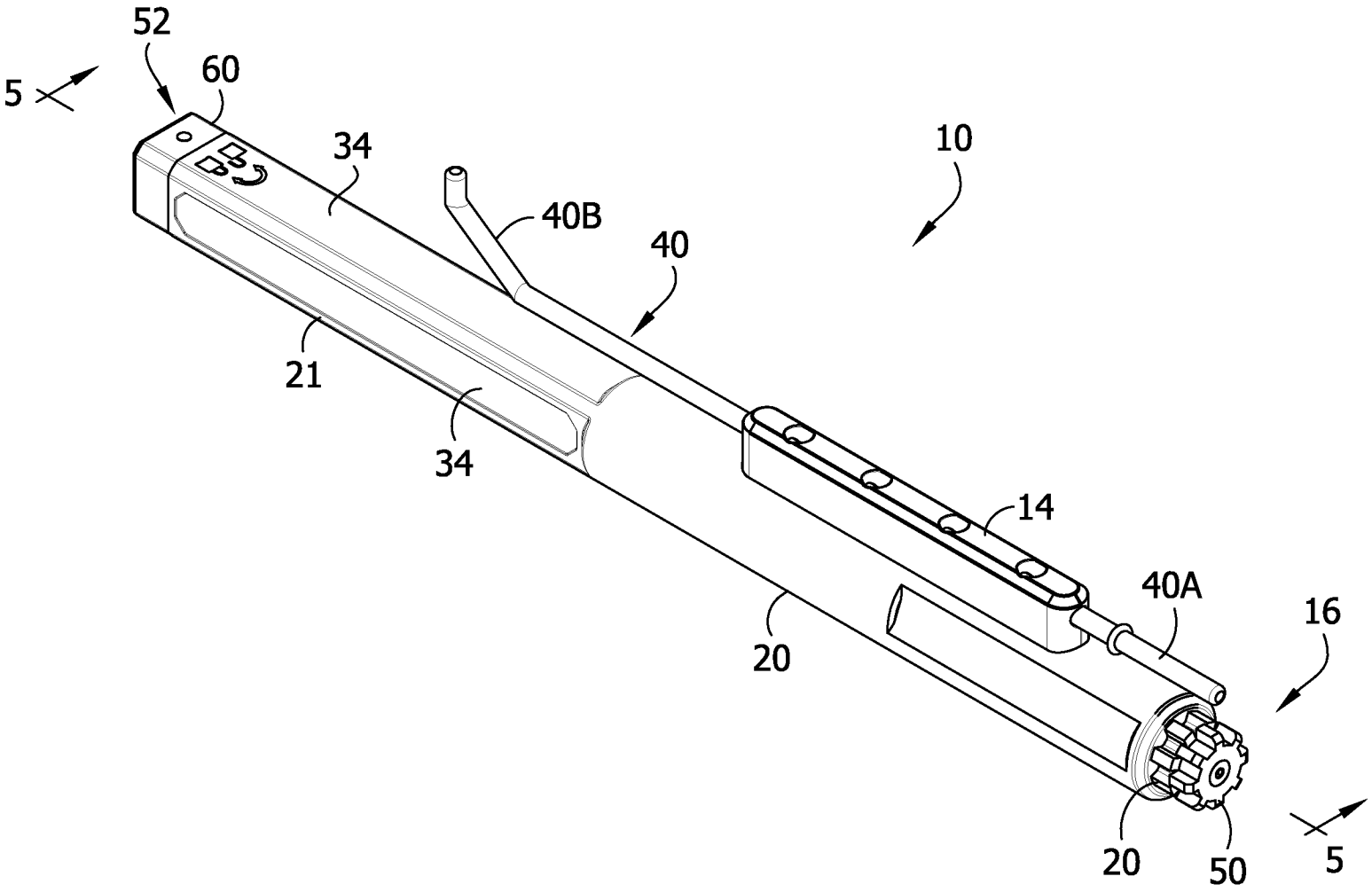
FIG. 2 is a front perspective of the firearm mount of FIG. 1 having a lock assembly shown in an unlocked configuration.
Figure 3:
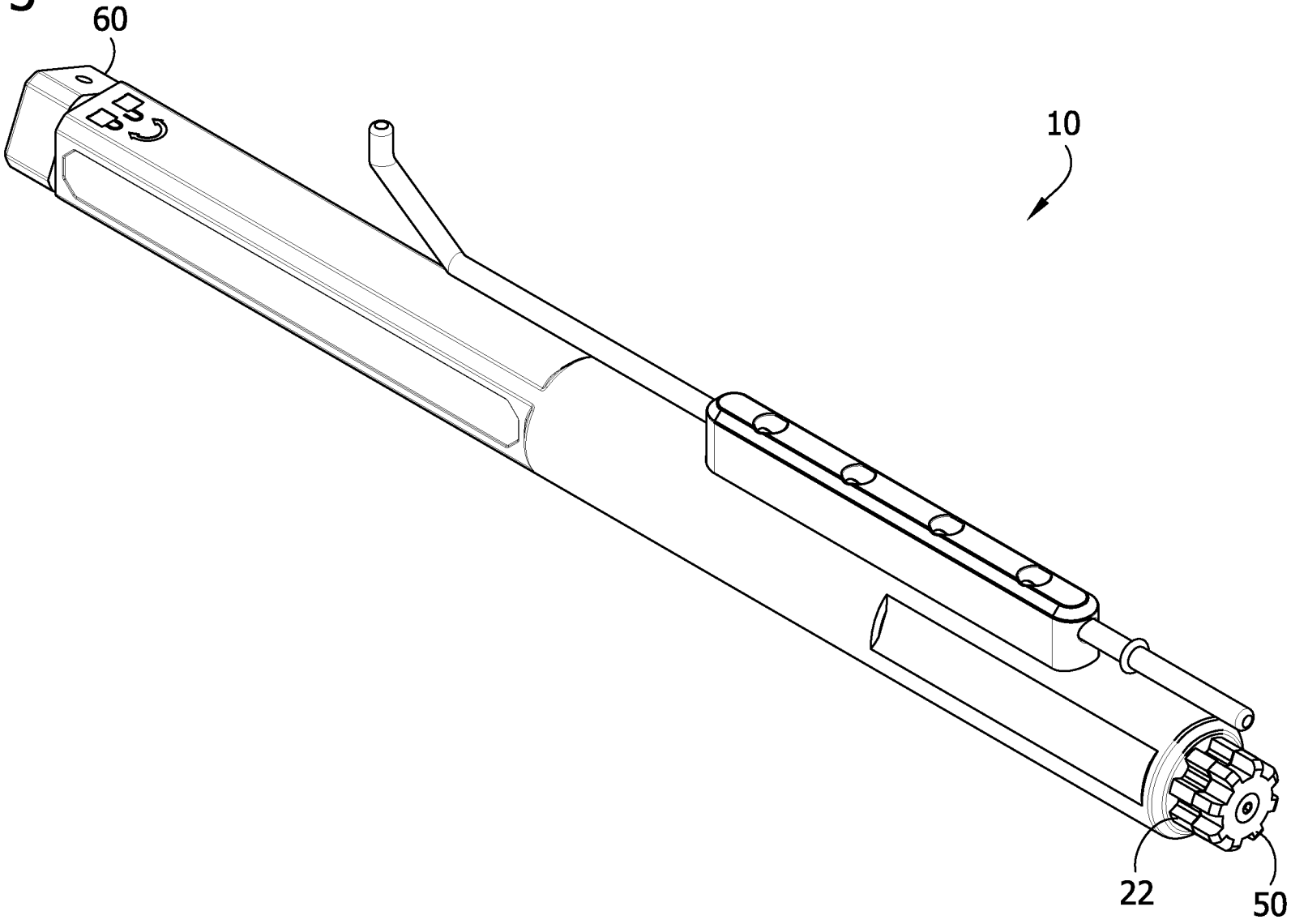
FIG. 3 is a view similar to FIG. 2 but showing the lock assembly in the locked configuration.
Figure 4:
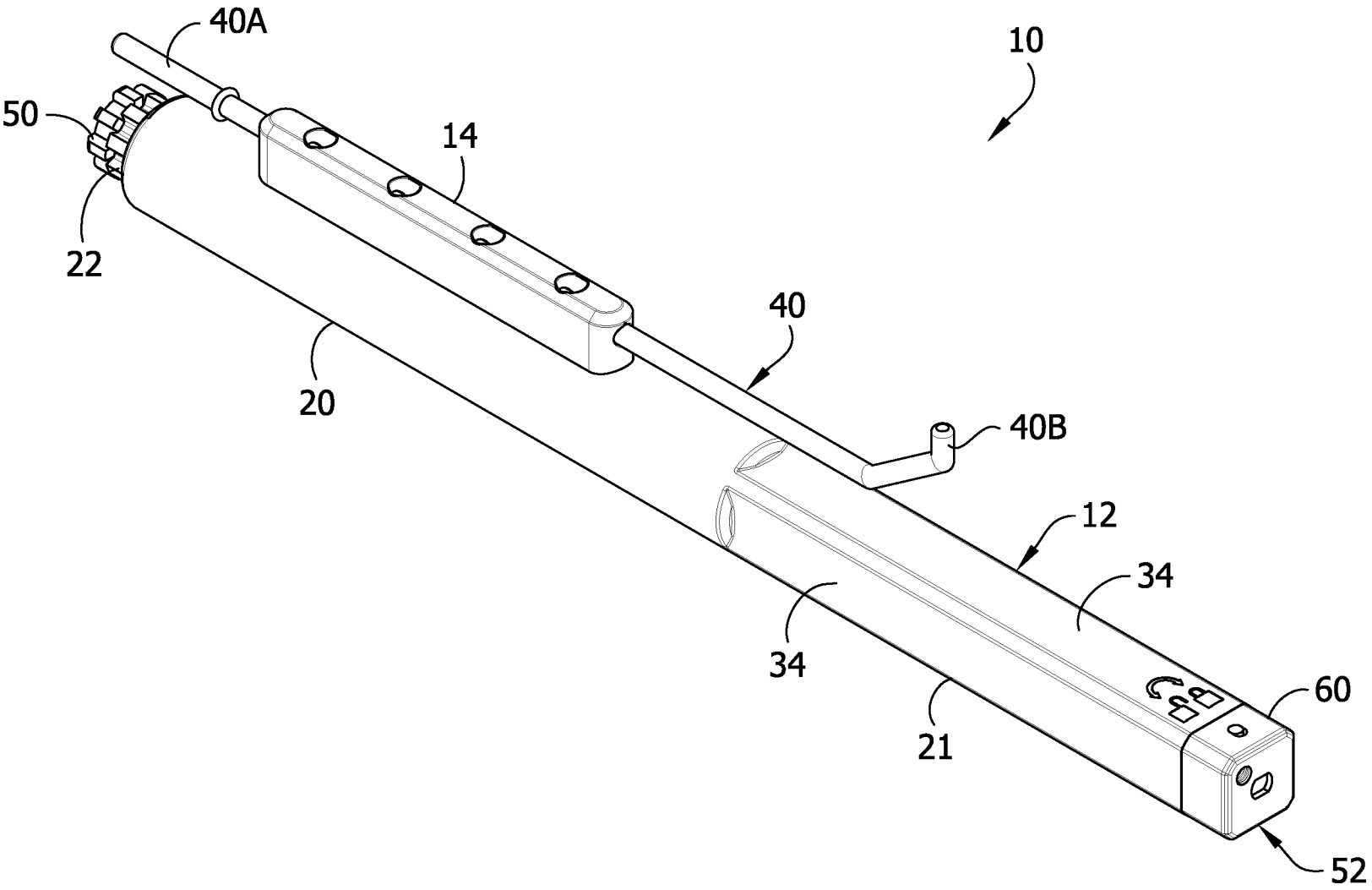
FIG. 4 is a rear perspective of the firearm mount having the lock assembly in the locked configuration.
Figure 5:
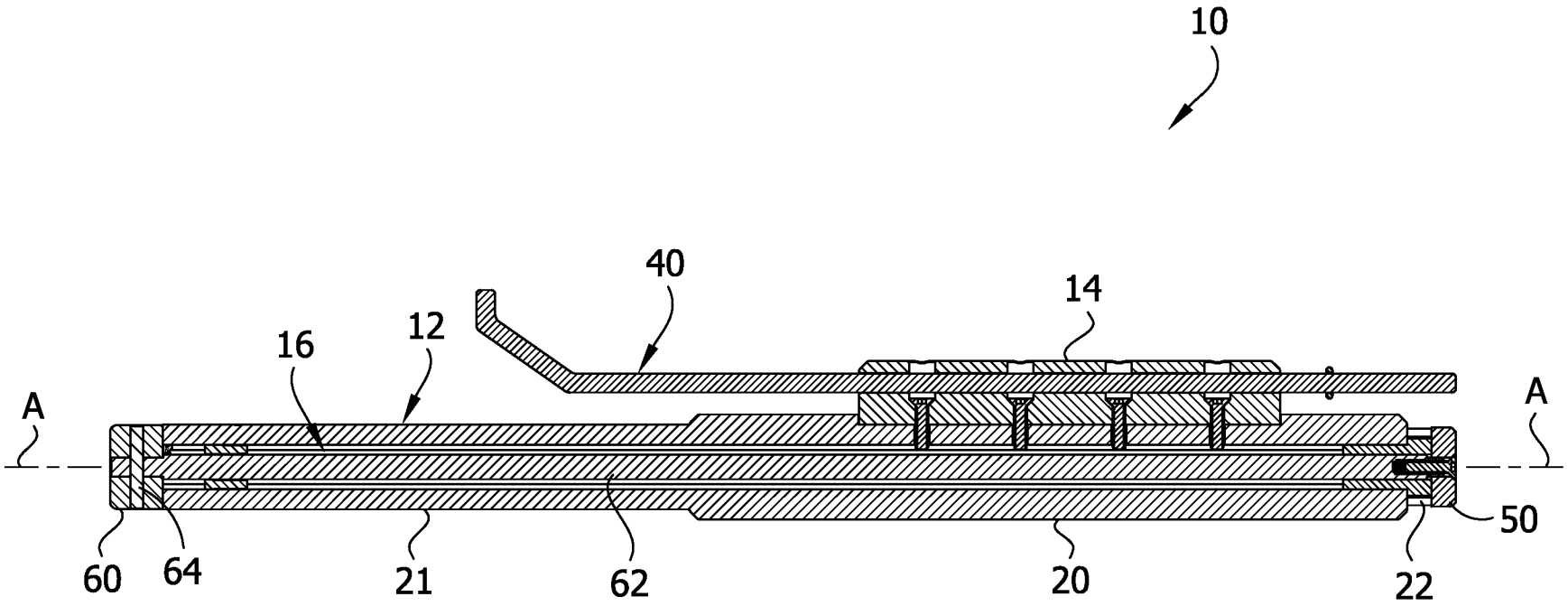
FIG. 5 is a section of the firearm mount taken in a plane including line 5-5 of FIG. 2.
Figure 6:
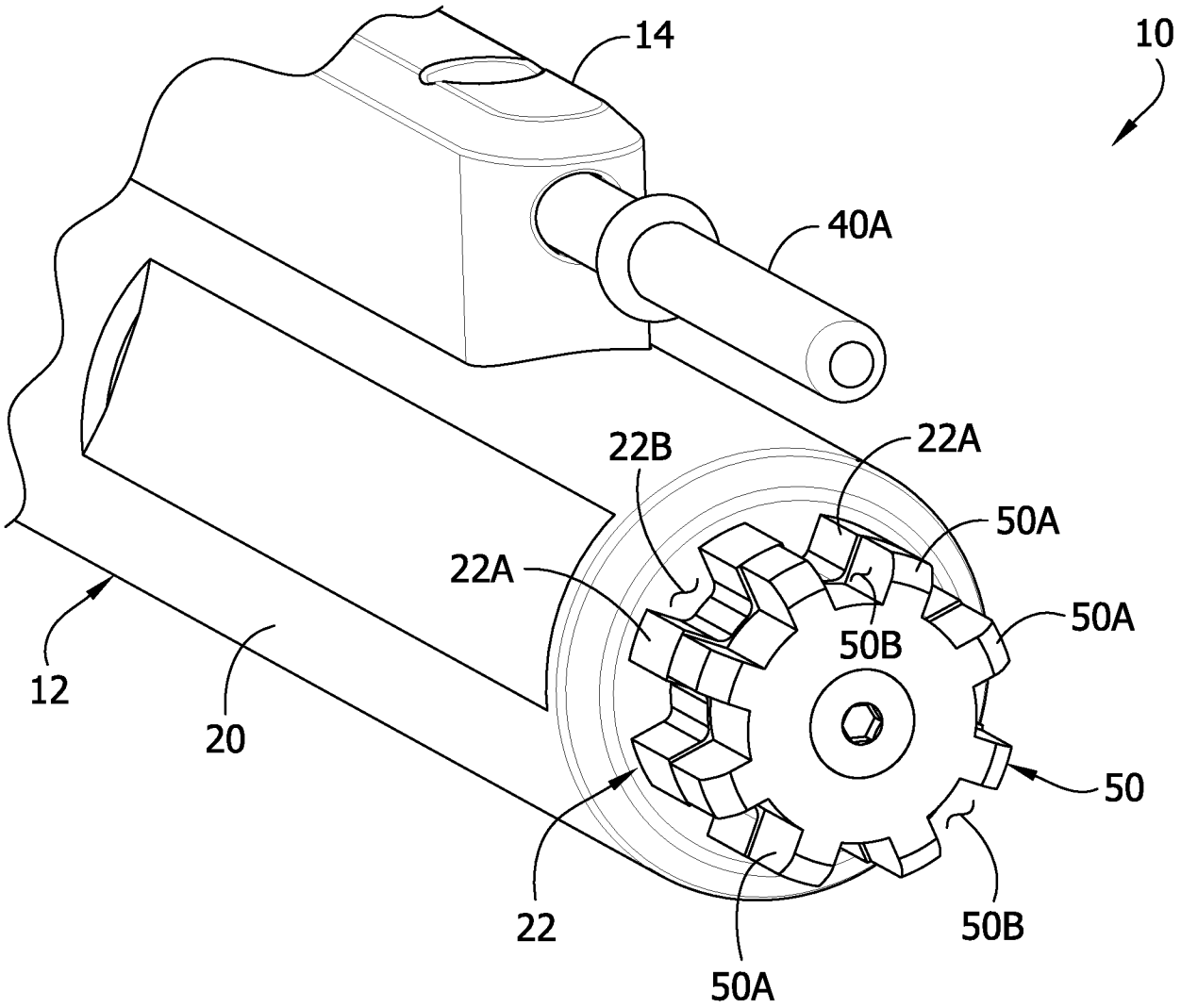
FIG. 6 is an enlarged fragmentary front perspective of the firearm mount showing a lock thereof in an unlocked position.

Referring to FIGS. 2 and 4, the main body 12 includes a forward portion 20 configured to be received in the upper receiver, and a rear portion 21 configured to be received in a vise. The forward portion 20 is generally cylindrical and includes a head 22. The head 22 is fixed in position relative to the remainder of the main body 12. The head 22 has a plurality of protruding alignment lugs 22A separated by a plurality of recesses 22B. The lugs 22A and recesses 22B are provided in an alternating pattern (i.e., lug, recess, lug, recess, etc.) around a circumference of the head 22. The lugs 22A are sized and shaped to be received in the recesses R in the barrel lug structure, and the recesses 22B are sized and shaped to receive lugs L of the barrel lug structure. The forward portion 20 and alignment lugs 22A are receivable in the upper receiver U by sliding the mount forward into the cavity C of the upper receiver and into the barrel extension BE to mesh the alignment lugs 22A with the barrel lugs L. Other types and configurations of main bodies can be used without departing from the scope of the present disclosure.

The torque transmitter 14 extends upward from the forward portion 20 and is sized and shaped to be received in the charging handle recess CR. In the illustrated embodiment, the torque transmitter 14 comprises a lug protruding upward from the main body 12 configured for a close fit in the charging handle recess CR. The torque transmitter 14 limits the upper receiver U from rotating relative to the firearm mount 10 about the forward portion 20 because the torque transmitter obstructs the upper receiver from rotating. The arrangement is such that when torque is applied to the upper receiver U (e.g., by rotating the barrel nut), the torque is transferred from the upper receiver to the torque transmitter 14 and thus the vise holding the firearm mount 10. Other types and configurations of torque transmitters can be used, and the torque transmitter can be omitted, without departing from the scope of the present disclosure.

The rear portion 21 includes a plurality of flats 34 arranged to be clamped by jaws of a vise for holding the mount 10 and thus the firearm assembly F securely in position with respect to the vise. The user can arrange the rear portion 21 between jaws of the vise and then reduce the space between the jaws to securely engage opposite flats 34 and thus grip the firearm mount. The rear portion 21 is exposed outside the upper receiver U to be engaged by the vise when the forward portion 20 is in the upper receiver and the alignment lugs 22A are in the barrel lug structure.

A gas tube alignment tool 40 is supported by the torque transmitter 14 for orienting the barrel nut N to properly align with a gas tube for cycling the action of the firearm. The gas tube alignment tool 40 includes a shaft 40A extending through a bore in the torque transmitter 14. The gas tube alignment tool includes a handle 40B connected to the shaft 40A for manipulating the shaft. In particular, a user grasps the handle 40B to slide the shaft 40A forward (e.g, FIGS. 1, 12, 13) and rearward (e.g., FIGS. 3-5) in the torque transmitter 14. When the barrel nut N is tightened on the upper receiver U to retain the barrel B, the barrel nut is indexed to position an opening OP (FIG. 11) in the barrel nut to receive a gas tube of the firearm assembly. The gas tube alignment tool 40 assists a user in properly indexing the barrel nut N. The shaft 40A is moved forward when the barrel nut N has been tightened on the upper receiver U to retain the barrel B thereon. If the shaft 40A does not slide through an opening OP in the barrel nut, the barrel nut is not properly indexed. The barrel nut is rotated slightly to properly align the opening therein for later reception of the gas tube. The user rotates the barrel nut N until the shaft 40A is slidable forward into an opening OP in the barrel nut N. The tool 40 can be pulled rearward out of the barrel nut N after proper indexing of the barrel nut N is achieved. Other types of gas tube alignment tools can be used, and the gas tube alignment tool can be omitted, without departing from the scope of the present disclosure.

The lock assembly 16 is configurable to selectively lock and unlock the firearm assembly F in position on the firearm mount 10. The lock assembly 16 includes a lock 50 and a lock actuator 52. The lock 50 is arranged to be received in the cylindrical cavity CC of the barrel extension BE in front of the barrel lug structure when the forward portion 20 of the main body 12 is in the upper receiver U and the alignment lugs 22A are in the barrel lug structure. The lock 50 includes a plurality of locking lugs 50A extending outward and spaced around a circumference of the lock. The locking lugs 50A are spaced from each other by recesses 50B. The locking lugs 50A each have an abutment surface 50A' (FIG. 13) adapted to engage the lugs L of the bolt lug structure to lock the firearm assembly 10 on the firearm mount 10. In particular, the locking lugs 50A have rearward facing abutment surfaces 50A' configured to engage forward facing surfaces L' of the barrel lugs L to obstruct the firearm assembly F from being moved forward off of the firearm mount 10. Other types and configurations of lock assemblies can be used, and the lock assembly can be omitted, without departing from the scope of the present disclosure.

The lock actuator 52 is configured to permit a user to move the lock 50 between unlocked and locked positions. The lock actuator 52 includes a handle 60 and a shaft 62 connecting the handle to the lock 50. The shaft 62 extends down a bore in the main body 12. In the illustrated embodiment, the handle 60, shaft 62, and lock 50 are conjointly rotatable about an axis of rotation A extending along and defined by the shaft 62. A pin 64 extends through the handle and rear end of the shaft 62 to connect the handle and shaft for conjoint rotation. The alignment lugs 22A and locking lugs 50A protrude radially outward away from the axis A. When the forward portion 20 of the main body 12 is received in the upper receiver U, and the alignment lugs 22A are meshed with the barrel lugs L, the handle 60 is exposed outside the upper receiver and accessible by a hand of the user for manually turning the handle about the axis A. The user turns the handle 60 by hand to cause the lock 50 to turn in the cylindrical recess CC in front of the barrel lug structure.

Figure 7:
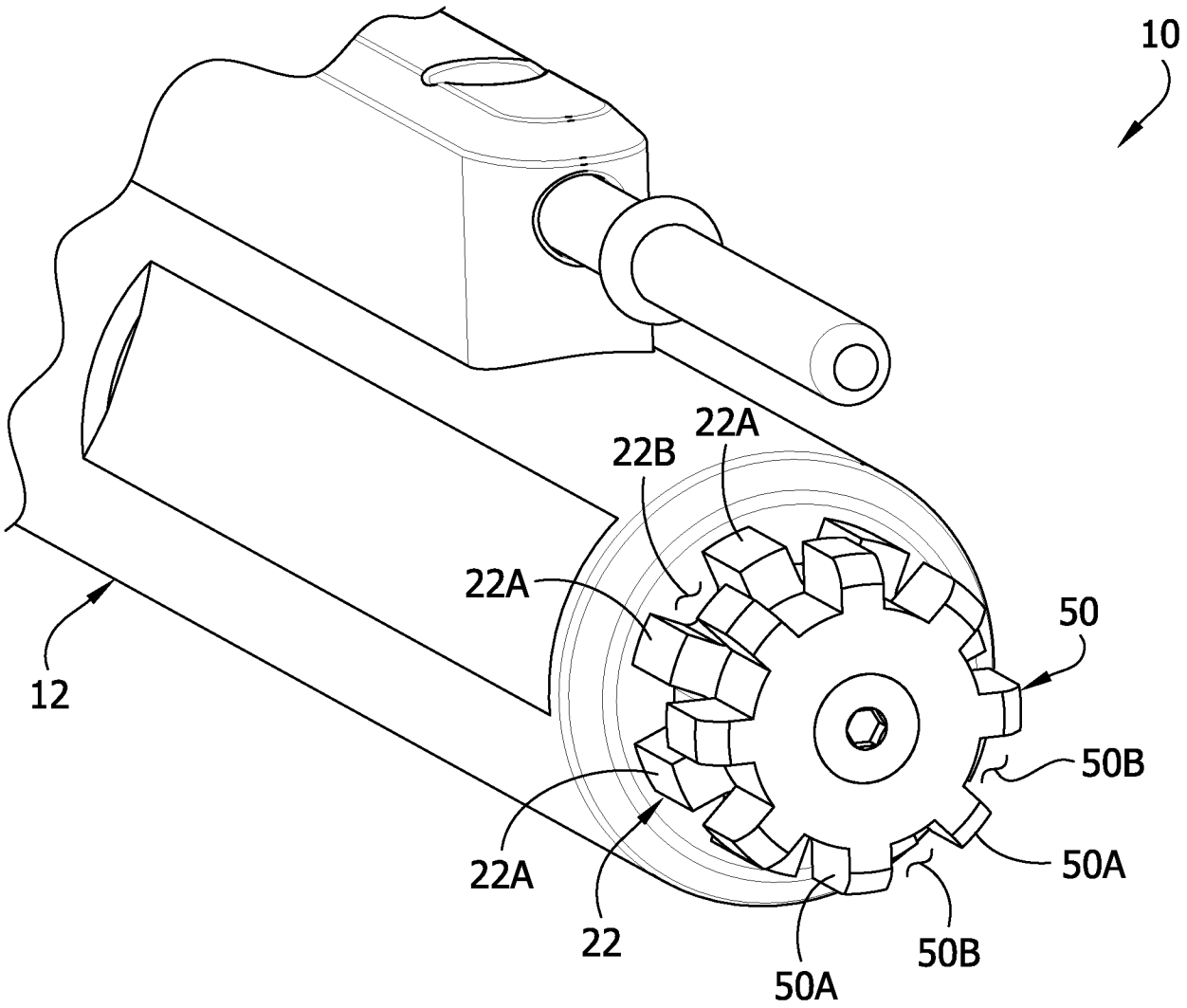
FIG. 7 is a view similar to FIG. 6 but showing the lock in a locked position.
Figure 8:
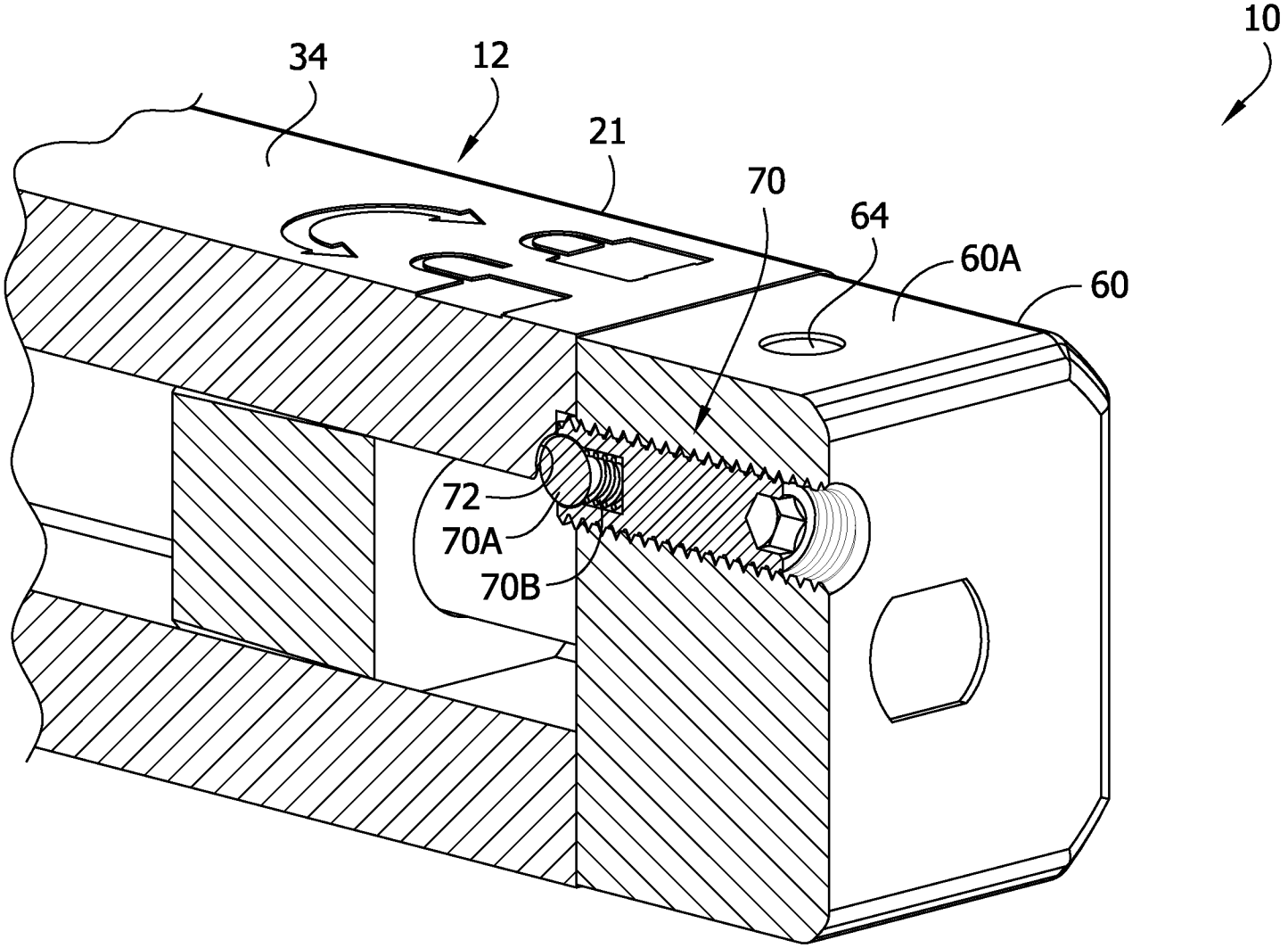
FIG. 8 is an enlarged fragmentary rear perspective of the firearm mount in section showing a handle thereof in a locked position.
Figure 9:
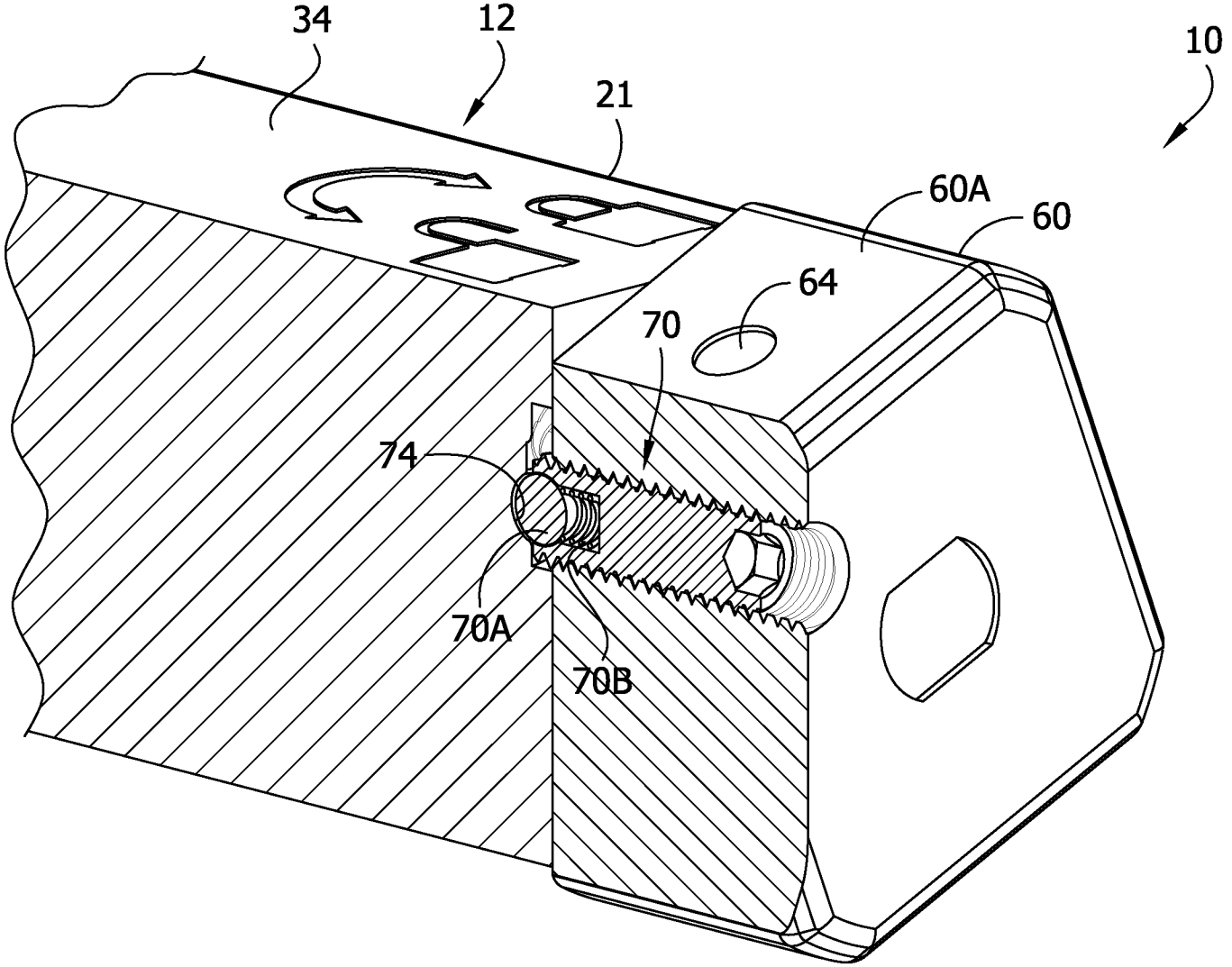
FIG. 9 is a view similar to FIG. 8 but showing the handle in an unlocked position.
Figure 10:
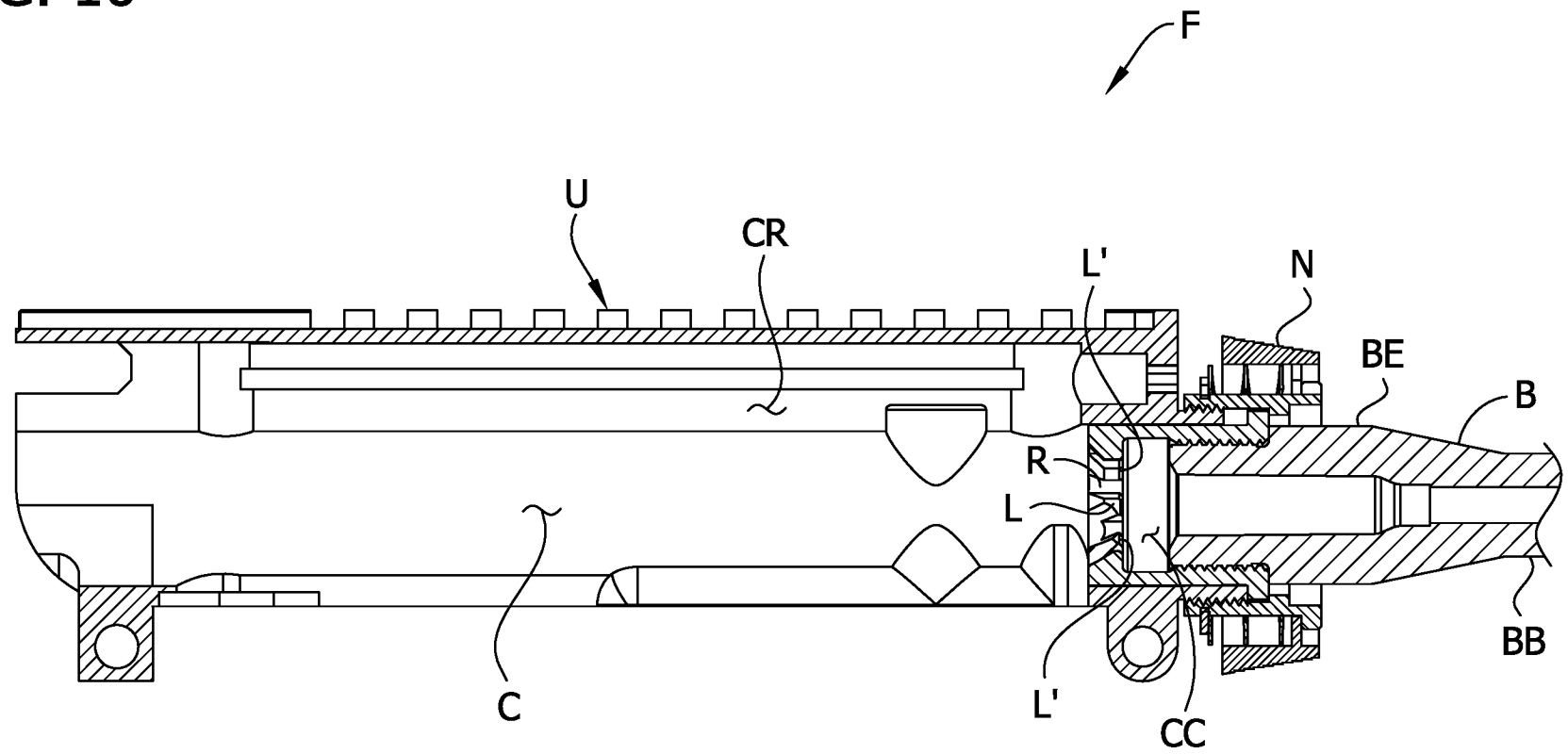
FIG. 10 is a fragmentary section of the firearm assembly of FIG. 1.
Figure 11:
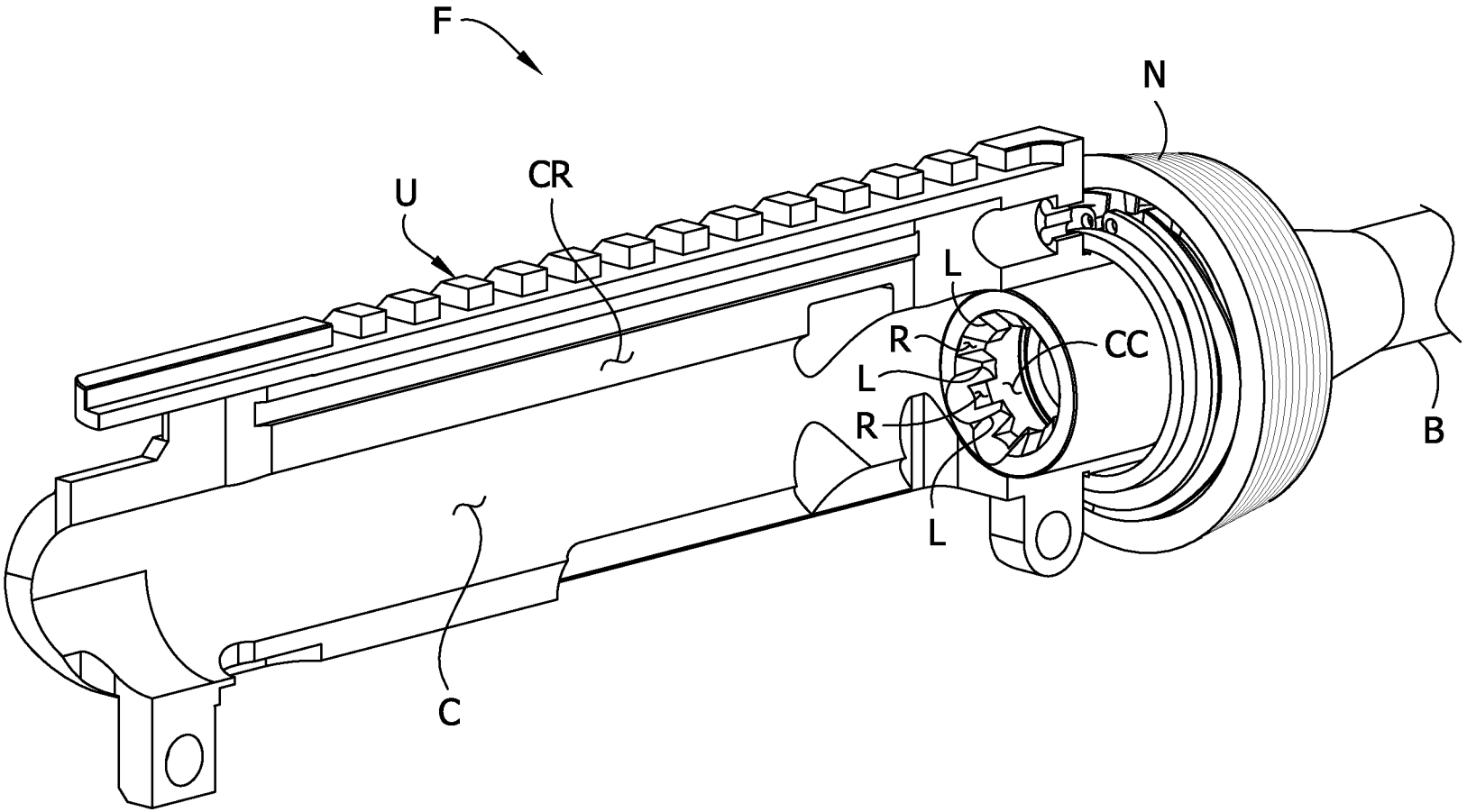
FIG. 11 is a rear fragmentary section of the firearm assembly having a right side wall of an upper receiver of the assembly removed to show internal barrel lug structure.
Figure 12:
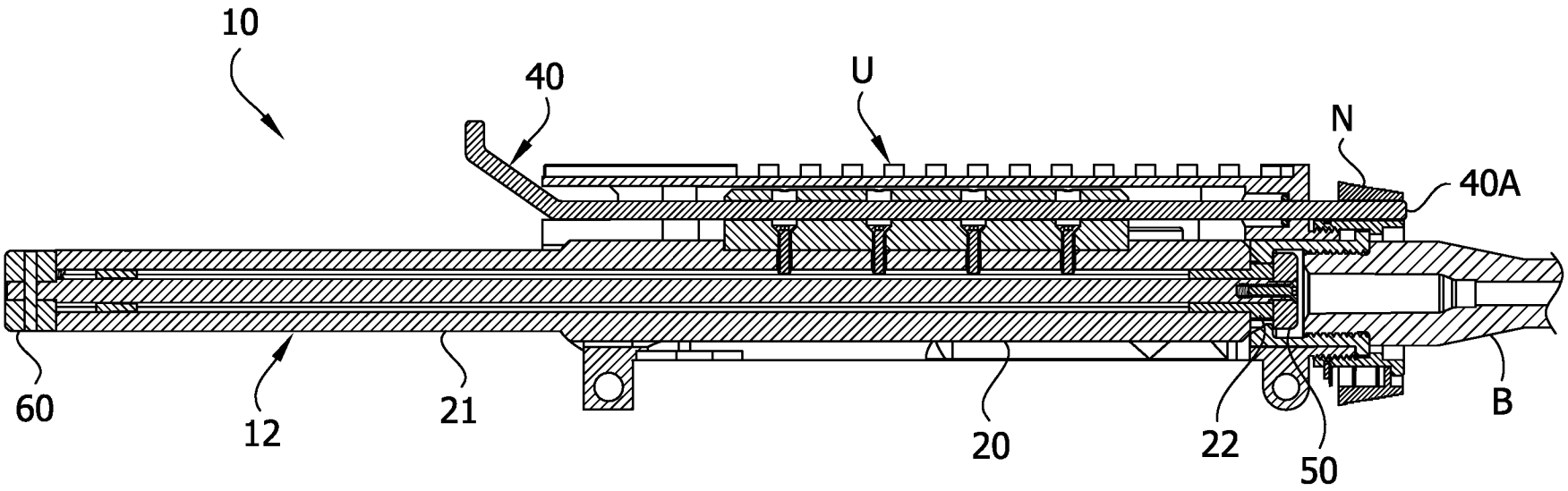
FIG. 12 is a fragmentary section of the firearm mount and firearm assembly taken in a plane including line 12-12 of FIG. 1.
Figure 13:
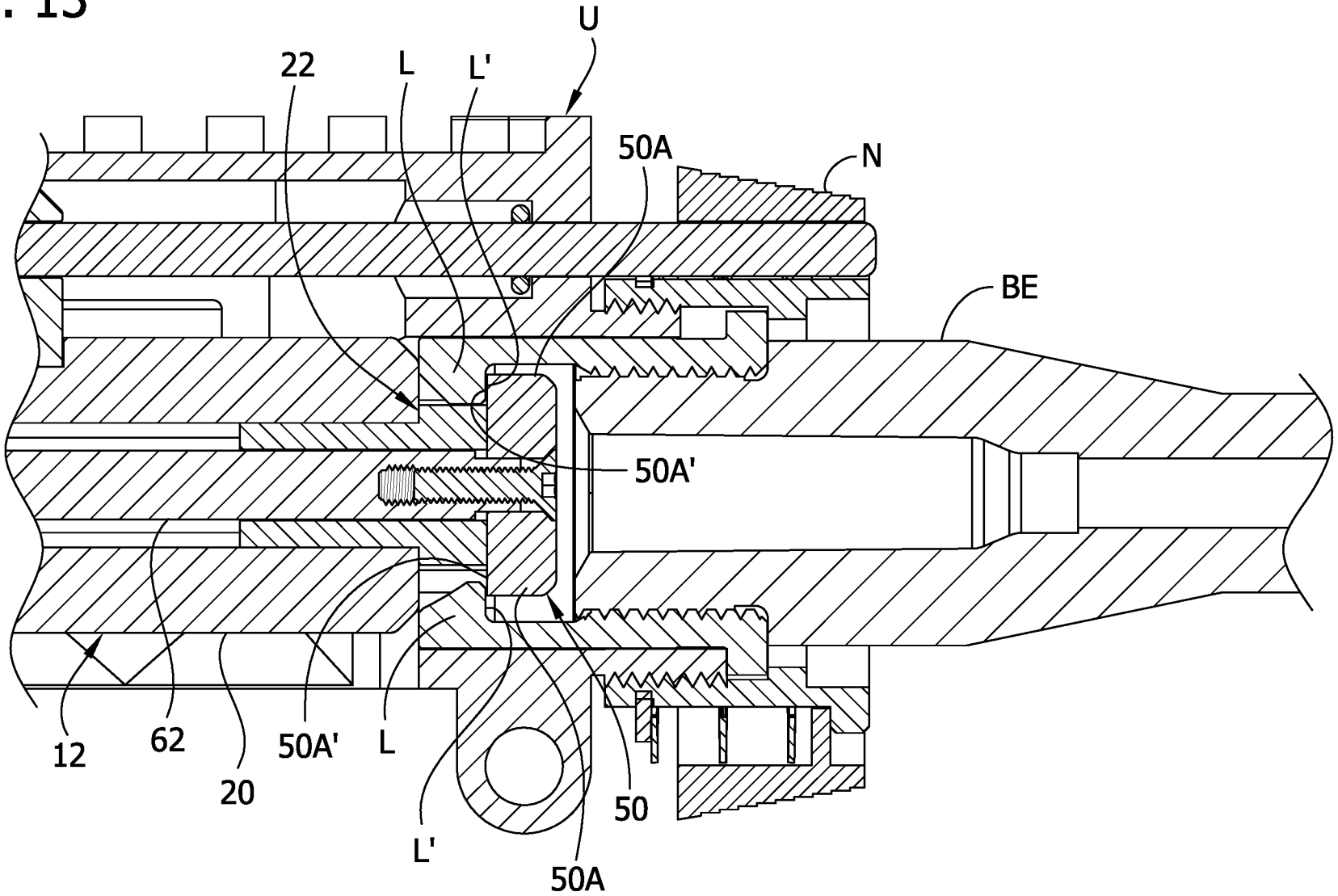
FIG. 13 is an enlarged view of a portion of FIG. 12.

The handle 60 has an unlocked position (e.g., FIG. 9) corresponding to the unlocked position of the lock 50 (e.g., FIG. 6), and the handle has a locked position (e.g., FIG. 8) corresponding to the locked position of the lock (e.g., FIG. 7). When the lock 50 is in the unlocked position, the locking lugs 50A are in register with (e.g., aligned with) the alignment lugs 22A for passing through the recesses R of the barrel lug structure. When the lock 50 is in the locked position, the locking lugs 50A are askew or out of alignment with the alignment lugs 22A such that the abutment surfaces 50A' of the locking lugs are located for engaging the forward facing surfaces L' of the barrel lugs L. In the locked position, individual ones of the locking lugs 50A are located to abut respective ones of the barrel lugs L.

When the handle 60 is in the locked position, flats 60A on sides of the handle are in register with flats 34 on sides of the rear portion 21 of the main body 12 such that the flats of the rear portion and the flats of the handle can both be engaged by the jaws of the vise. Thus, in the locked position, the handle 60 does not obstruct the vise from flatly engaging the flats 34 of the main body 12, and engagement of the vise with the handle 60 prevents the handle from rotating out of the locked position. Other types and configurations of handles can be used, and the handle can be omitted, without departing from the scope of the present disclosure.

A retainer 70 is provided for retaining the lock 50 in the unlocked and locked positions. In the illustrated embodiment, the retainer 70 comprises a detent carried by the handle 60 and receivable in recesses 72, 74 in the rear end of the main body 12 for maintaining the handle in the unlocked and locked positions and thus for maintaining the lock 50 in the corresponding unlocked and locked positions. The detent 70 comprises a ball 70A biased forward by a spring 70B for protruding forward out of the handle 60 into a respective one of the recesses 72, 74. When the handle 60 is in the unlocked or locked position, reception of the spring biased ball 70A in the corresponding recess 72, 74 creates resistance against the handle rotating out of the position. When the user applies sufficient rotational force to the handle 60, the ball 70A dislodges from the recess, permitting the handle to be rotated to the other of the unlocked or locked positions. When the handle 60 arrives at the other of the unlocked or locked positions, the ball 70A engages the corresponding recess 72, 74 and thus retains the handle and lock 50 in position. Other types and configurations or retainers can be used, and the retainer can be omitted, without departing from the scope of the present disclosure.

In a method of using the firearm mount 10, the firearm mount is inserted in a firearm assembly F including an upper receiver U and a barrel B. The barrel B may or may not already be secured to the upper receiver U by a barrel nut N. The firearm mount 10 is moved forward into the cavity C of the upper receiver U such that the lock 50 passes through the barrel lug structure into the cavity CC and the alignment lugs 20A become meshed with the barrel lugs L. With the locking lugs 50A in the cylindrical cavity CC in front of the barrel lugs L, the user can turn the handle 60 to turn the lock 50 from the unlocked position to the locked position. The locking lugs 50A in the locking position are out of alignment with the alignment lugs 22A and are positioned to engage the barrel lugs L and thus obstruct forward movement of the barrel lugs and prevent removal of the firearm assembly F. The firearm mount 10 can be secured in a vise before or after the firearm assembly is installed thereon.

While the firearm assembly F is locked on the firearm mount 10, various tasks can be performed. The barrel nut N can be installed/removed. A hand guard can be installed or removed. An accessory can be installed on or removed from the firearm assembly. For example, a muzzle brake, flash hider, or other muzzle accessory can be a can be installed or removed. A sight (e.g., red dot sight, scope, laser, etc.), light, and/or bipod can be installed or removed. Forces applied to the firearm assembly F are transmitted to the firearm mount (e.g., via the torque transmitter 14, the alignment lugs 22A, and/or the main body 12 generally) and thus to the vise. This protects the upper receiver U from damage by distributing and transmitting force. If the firearm assembly F is pulled forward (e.g., the barrel B is pulled forward), the firearm assembly is prevented from sliding forward off the firearm mount 10 by the engagement of the locking lugs 50A with the barrel lugs L. After the cleaning, maintenance, gunsmithing and/or other tasks are completed, the firearm mount 10 can be removed from the vise, the lock 50 can be unlocked, and the firearm assembly F can be removed from the firearm mount.

It will be apparent that modifications and variations are possible without departing from the appended claims. As various changes could be made in the above constructions and methods without departing from the scope of the claims, it is intended that all matter contained in the above description and shown in the accompanying drawings shall be interpreted as illustrative and not in a limiting sense.

What is claimed is:

1. A firearm mount for supporting a firearm assembly of a firearm, the firearm assembly including an upper receiver for receiving a bolt carrier group of the firearm and a barrel having barrel lug structure, the firearm mount comprising:

a main body, the main body including a rear portion and a forward portion, the forward portion being sized and shaped to be received in the upper receiver of the firearm assembly in place of the bolt carrier group when the bolt carrier group is removed from the upper receiver of the firearm assembly;

a lock supported by the main body, the lock comprising at least one locking lug, the at least one locking lug being movable with respect to the forward portion between an unlocked position and a locked position, the lock being configured to be movable with respect to the main body to permit movement of the at least one locking lug from the unlocked position to the locked position, when the forward portion is in the upper receiver and the at least one locking lug is in the barrel, to locate the at least one locking lug for engaging the barrel lug structure to obstruct removal of the firearm assembly from the main body;

a lock actuator supported by the main body and moveable relative to the main body, the lock actuator operatively coupled to the lock to move the lock between the unlocked and locked positions; and a retainer configured to retain the lock in position with respect to the main body to retain the lock in at least one of the unlocked position or the locked position;

further comprising a gas tube alignment tool including a rod portion receivable in an opening of a barrel nut of the firearm assembly, the gas tube alignment tool being movable forward and rearward with respect to the main body for moving the rod portion into and out of the opening of the barrel nut.

2. A firearm mount for supporting a firearm assembly of a firearm, the firearm assembly including an upper receiver for receiving a bolt carrier group of the firearm and a barrel having barrel lug structure, the firearm mount comprising:

a main body including a forward portion, the forward portion being sized and shaped to be received in the upper receiver of the firearm assembly in place of the bolt carrier group when the bolt carrier group is removed from the upper receiver of the firearm assembly;

a lock supported by the main body, the lock comprising at least one locking lug, the at least one locking lug being movable with respect to the forward portion between an unlocked position and a locked position, the lock being configured to be movable with respect to the main body to permit movement of the at least one locking lug from the unlocked position to the locked position, when the forward portion is in the upper receiver and the at least one locking lug is in the barrel, to locate the at least one locking lug for engaging the barrel lug structure to obstruct removal of the firearm assembly from the main body;

a lock actuator supported by the main body and moveable relative to the main body, the lock actuator being operatively coupled to the lock to move the lock between the unlocked and locked positions; and a retainer configured to retain the lock in position with respect to the main body to retain the lock in at least one of the unlocked position or the locked position;

wherein a portion of the main body is configured to extend out from the upper receiver and is configured to support the firearm mount and the firearm assembly when the forward portion of the main body is received in the upper receiver of the firearm assembly in place of the bolt carrier group.

3. The firearm mount as set forth in claim 2, wherein the retainer is configured to retain the lock in position with respect to the main body to retain the lock in the unlocked position.

4. The firearm mount as set forth in claim 2, wherein the retainer is configured to retain the lock in position with respect to the main body to retain the lock in the locked position.

5. The firearm mount as set forth in claim 2, wherein the retainer is configured to retain the lock in position with respect to the main body to retain the lock in the unlocked position and the locked position.

6. The firearm mount as set forth in claim 2, wherein the retainer is arranged to engage the main body to retain the lock in at least one of the unlocked position or the locked position.

7. The firearm mount as set forth in claim 2, wherein said portion of the main body includes flats adapted for engagement with jaws of a vise.

8. The firearm mount as set forth in claim 7, wherein the lock actuator includes flats configured to align with the flats of said portion of the main body when the lock is in the locked position.

9. The firearm mount as set forth in claim 2, wherein the at least one locking lug is supported to be movable with respect to forward portion between the unlocked and locked positions about an axis of rotation, the axis of rotation extending along a length of the main body.

10. The firearm mount as set forth in claim 2, wherein the at least one locking lug has a barrel lug structure abutment surface arranged to engage the barrel lug structure when the forward portion is received in the upper receiver, the at least one locking lug is in the barrel, and the lock is moved to the locked position, the barrel lug structure abutment surface facing rearward toward said portion of the main body.

11. The firearm mount as set forth in claim 2, wherein the at least one locking lug is sized and shaped to be passed forward through a recess of the barrel lug structure to locate the at least one locking lug to be moved to the locking position for obstructing removal of the firearm assembly from the main body.

12. The firearm mount as set forth in claim 2, wherein the at least one locking lug comprises a plurality of locking lugs, each of the locking lugs located to engage the barrel lug structure to obstruct removal of the firearm assembly from the main body when the forward portion is in the upper receiver, the plurality of locking lugs are in the barrel, and the lock is moved to the locked position.

13. The firearm mount as set forth in claim 2, wherein the lock actuator and lock are rotatable relative to the main body about an axis of rotation extending along a length of the main body.

14. The firearm mount as set forth in claim 2, wherein the portion is configured to be connected to a support to hold the firearm mount and firearm assembly in position.

15. The firearm mount as set forth in claim 2, wherein the lock actuator includes a handle and a shaft supported by the main body and rotatable relative to the main body, the handle and the lock being coupled to and conjointly rotatable with the shaft such that rotation of the handle rotates the shaft and the lock to move the at least one locking lug between the locked and unlocked positions.

16. A firearm mount for supporting a firearm assembly of a firearm, the firearm assembly including an upper receiver for receiving a bolt carrier group of the firearm and a barrel having barrel lug structure, the firearm mount comprising:

a main body, the main body including a rear portion and a forward portion, the forward portion being sized and shaped to be received in the upper receiver of the firearm assembly in place of the bolt carrier group when the bolt carrier group is removed from the upper receiver of the firearm assembly;

a lock supported by the main body, the lock comprising at least one locking lug, the at least one locking lug being movable with respect to the forward portion between an unlocked position and a locked position, the lock being configured to be movable with respect to the main body to permit movement of the at least one locking lug from the unlocked position to the locked position, when the forward portion is in the upper receiver and the at least one locking lug is in the barrel, to locate the at least one locking lug for engaging the barrel lug structure to obstruct removal of the firearm assembly from the main body;

a lock actuator supported by the main body and moveable relative to the main body, the lock actuator operatively coupled to the lock to move the lock between the unlocked and locked positions; and a retainer configured to retain the lock in position with respect to the main body to retain the lock in at least one of the unlocked position or the locked position;

wherein the retainer comprises a detent arranged to retain the lock in at least one of the unlocked position or the locked position.

17. The firearm mount as set forth in claim 16, wherein the detent is receivable in a first recess to retain the lock in the unlocked position.

18. The firearm mount as set forth in claim 17, wherein the detent is receivable in a second recess to retain the lock in the locked position.

19. The firearm mount as set forth in claim 16, wherein the retainer comprises a spring configured to bias the detent toward a retaining position.

20. A firearm mount for supporting a firearm assembly of a firearm, the firearm assembly including an upper receiver for receiving a bolt carrier group of the firearm and a barrel having barrel lug structure, the firearm mount comprising:

a main body, the main body including a rear portion and a forward portion, the forward portion being sized and shaped to be received in the upper receiver of the firearm assembly in place of the bolt carrier group when the bolt carrier group is removed from the upper receiver of the firearm assembly;

a lock supported by the main body, the lock comprising at least one locking lug, the at least one locking lug being movable with respect to the forward portion between an unlocked position and a locked position, the lock being configured to be movable with respect to the main body to permit movement of the at least one locking lug from the unlocked position to the locked position, when the forward portion is in the upper receiver and the at least one locking lug is in the barrel, to locate the at least one locking lug for engaging the barrel lug structure to obstruct removal of the firearm assembly from the main body;

a lock actuator supported by the main body and moveable relative to the main body, the lock actuator operatively coupled to the lock to move the lock between the unlocked and locked positions; and a retainer configured to retain the lock in position with respect to the main body to retain the lock in at least one of the unlocked position or the locked position;

wherein the main body is configured to extend out from the upper receiver such that the rear portion is exposed to be engaged by jaws of a vise to hold the firearm assembly in position relative to the vise when the forward portion is received in the upper receiver and the lock is in the locked position to obstruct removal of the firearm assembly from the main body.

21. A firearm mount for supporting a firearm assembly of a firearm, the firearm assembly including an upper receiver for receiving a bolt carrier group of the firearm and a barrel having barrel lug structure, the firearm mount comprising:

a main body, the main body including a rear portion and a forward portion, the forward portion being sized and shaped to be received in the upper receiver of the firearm assembly in place of the bolt carrier group when the bolt carrier group is removed from the upper receiver of the firearm assembly;

a lock supported by the main body, the lock comprising at least one locking lug, the at least one locking lug being movable with respect to the forward portion between an unlocked position and a locked position, the lock being configured to be movable with respect to the main body to permit movement of the at least one locking lug from the unlocked position to the locked position, when the forward portion is in the upper receiver and the at least one locking lug is in the barrel, to locate the at least one locking lug for engaging the barrel lug structure to obstruct removal of the firearm assembly from the main body;

at least one alignment lug rearward from the at least one locking lug, the at least one alignment lug being located to be received in a recess of the barrel lug structure when the forward portion is in the upper receiver and the at least one locking lug is moved to the locked position to obstruct removal of the firearm assembly from the main body;

a lock actuator supported by the main body and moveable relative to the main body, the lock actuator operatively coupled to the lock to move the lock between the unlocked and locked positions; and a retainer configured to retain the lock in position with respect to the main body to retain the lock in at least one of the unlocked position or the locked position.

22. The firearm mount as set forth in claim 21, wherein a portion of the main body is configured to extend out from the upper receiver and is configured to support the firearm mount and the firearm assembly when the forward portion of the main body is received in the upper receiver of the firearm assembly in place of the bolt carrier group.

23. The firearm mount as set forth in claim 22, wherein the portion is configured to be connected to a support to hold the firearm mount and firearm assembly in position.

24. The firearm mount as set forth in claim 21, wherein the main body is configured to extend out from the upper receiver such that the rear portion is exposed to be engaged by jaws of a vise to hold the firearm assembly in position relative to the vise when the forward portion is received in the upper receiver and the lock is in the locked position to obstruct removal of the firearm assembly from the main body.

25. The firearm mount as set forth in claim 21, wherein the retainer is configured to retain the lock in position with respect to the main body to retain the lock in the unlocked position and the locked position.

26. The firearm mount as set forth in claim 25, wherein the retainer comprises a detent arranged to retain the lock in at least one of the unlocked position or the locked position.

27. The firearm mount as set forth in claim 26, wherein the detent is carried by the lock actuator.

28. The firearm mount as set forth in claim 27, wherein the retainer comprises a spring configured to bias the detent toward a retaining position.

29. The firearm mount as set forth in claim 21, wherein the lock actuator includes a handle and a shaft supported by the main body and rotatable relative to the main body, the handle and the lock being coupled to and conjointly rotatable with the shaft such that rotation of the handle rotates the shaft and the lock to move the at least one locking lug between the locked and unlocked positions.

30. The firearm mount as set forth in claim 21, wherein the lock actuator, the retainer, and the lock are rotatable relative to the main body about an axis of rotation extending along a length of the main body.

31. The firearm mount as set forth in claim 21, wherein the at least one locking lug is sized and shaped to be passed forward through a recess of the barrel lug structure to locate the at least one locking lug to be moved to the locking position for obstructing removal of the firearm assembly from the main body.

32. A firearm mount for supporting a firearm assembly of a firearm, the firearm assembly including an upper receiver for receiving a bolt carrier group of the firearm and a barrel having barrel lug structure, the firearm mount comprising:

a main body, the main body including a rear portion and a forward portion, the forward portion being sized and shaped to be received in the upper receiver of the firearm assembly in place of the bolt carrier group when the bolt carrier group is removed from the upper receiver of the firearm assembly;

a lock supported by the main body, the lock comprising at least one locking lug, the at least one locking lug being movable with respect to the forward portion between an unlocked position and a locked position, the lock being configured to be movable with respect to the main body to permit movement of the at least one locking lug from the unlocked position to the locked position, when the forward portion is in the upper receiver and the at least one locking lug is in the barrel, to locate the at least one locking lug for engaging the barrel lug structure to obstruct removal of the firearm assembly from the main body;

a lock actuator supported by the main body and moveable relative to the main body, the lock actuator operatively coupled to the lock to move the lock between the unlocked and locked positions; and a retainer configured to retain the lock in position with respect to the main body to retain the lock in at least one of the unlocked position or the locked position, the retainer being carried by the lock actuator.

33. The firearm mount as set forth in claim 32, wherein a portion of the main body is configured to extend out from the upper receiver and is configured to support the firearm mount and the firearm assembly when the forward portion of the main body is received in the upper receiver of the firearm assembly in place of the bolt carrier group.

34. The firearm mount as set forth in claim 33, wherein the portion is configured to be connected to a support to hold the firearm mount and firearm assembly in position.

35. The firearm mount as set forth in claim 32, wherein the main body is configured to extend out from the upper receiver such that the rear portion is exposed to be engaged by jaws of a vise to hold the firearm assembly in position relative to the vise when the forward portion is received in the upper receiver and the lock is in the locked position to obstruct removal of the firearm assembly from the main body.

36. The firearm mount as set forth in claim 32, wherein the retainer is configured to retain the lock in position with respect to the main body to retain the lock in the unlocked position and the locked position.

37. The firearm mount as set forth in claim 36, wherein the retainer is arranged to engage the main body to retain the lock in the unlocked position and the locked position.

38. The firearm mount as set forth in claim 37, wherein the retainer comprises a detent arranged to retain the lock in the unlocked position and the locked position.

39. The firearm mount as set forth in claim 38, wherein the retainer comprises a spring arranged to bias the detent toward the main body.

40. The firearm mount as set forth in claim 32, wherein the lock actuator includes a handle and a shaft supported by the main body and rotatable relative to the main body, the handle and the lock being coupled to and conjointly rotatable with the shaft such that rotation of the handle rotates the shaft and the lock to move the at least one locking lug between the locked and unlocked positions.

41. The firearm mount as set forth in claim 32, wherein the lock actuator, the retainer, and the lock are rotatable relative to the main body about an axis of rotation extending along a length of the main body.

42. The firearm mount as set forth in claim 32, wherein the at least one locking lug is sized and shaped to be passed forward through a recess of the barrel lug structure to locate the at least one locking lug to be moved to the locking position for obstructing removal of the firearm assembly from the main body.

43. A firearm mount system for supporting a firearm assembly of a firearm for maintenance, the firearm assembly including an upper receiver for receiving a bolt carrier group of the firearm and a barrel having barrel lug structure, the system comprising:

a firearm connector sized and shaped to be received in the upper receiver of the firearm assembly in place of the bolt carrier group when the bolt carrier group is removed from the upper receiver of the firearm assembly, the firearm connector including a lock comprising at least one locking lug, the at least one locking lug being configured to be movable between an unlocked position and a locked position, when the firearm connector is in the upper receiver and the at least one locking lug is in the barrel, to locate the at least one locking lug for engaging the barrel lug structure to obstruct removal of the firearm assembly from the firearm connector; and a firearm connector support structure configured to support the firearm connector and the firearm assembly in position for maintenance when the firearm connector is received in the upper receiver of the firearm assembly in place of the bolt carrier group.

44. The firearm mount as set forth in claim 43, wherein the firearm connector support structure includes a support connector configured to be disposed outside the upper receiver when the firearm connector is received in the upper receiver of the firearm assembly in place of the bolt carrier group.

45. The firearm mount as set forth in claim 44, wherein the firearm connector support structure comprises a holder configured to hold the firearm connector to support the firearm connector and the firearm assembly in position for maintenance when the firearm connector is received in the upper receiver of the firearm assembly in place of the bolt carrier group.

46. The firearm mount as set forth in claim 45, wherein the holder comprises a vise.

47. The firearm mount as set forth in claim 44, wherein the support connector includes flats adapted for engagement with a holder.

48. The firearm mount as set forth in claim 43, further comprising a lock actuator operatively coupled to the lock to move the lock between the unlocked and locked positions.

49. The firearm mount as set forth in claim 43, wherein the at least one locking lug is sized and shaped to be passed forward through a recess of the barrel lug structure to locate the at least one locking lug to be moved to the locking position for obstructing removal of the firearm assembly from the main body.

* * * * *